United States Patent [19]

McGeary et al.

[11] 4,319,131

[45] Mar. 9, 1982

[54] SCORE RECORD PROCESSING SYSTEM

[76] Inventors: Thomas C. McGeary, 2412 Palos Verdes Dr. West; Angus A. Scott, 2709 Paseo del Mar, both of Palos Verdes Estates, Calif. 90274

[21] Appl. No.: 198,313

[22] Filed: Oct. 20, 1980

Related U.S. Application Data

[63] Continuation-in-part of Ser. No. 100,572, Dec. 5, 1979, Pat. No. 4,268,744.

[51] Int. Cl.[3] ..... G06F 15/20

[52] U.S. Cl. ..... 235/375; 235/431; 235/493

[58] Field of Search ..... 235/375, 419, 431, 432, 235/434, 493

[56] References Cited

U.S. PATENT DOCUMENTS 4,268,744 5/1981 McGeary ..... 235/375

*Primary Examiner*—Harold I. Pitts

*Attorney, Agent, or Firm*—Nilsson, Robbins, Dalgarn, Berliner, Carson & Wurst

[57] ABSTRACT

A system is disclosed for use in cooperation with record cards and identification cards to indicate scoring data. In the disclosed system, the record cards incorporate a magnetic stripe and preserve duplicate printed and magnetic records of scoring data, e.g. a golfer's handicap. The system includes an operating unit with a card printer. Playing data is entered for processing and for entry on a record card and for use in issuing identification cards that indicate a player's handicap. The functions of the operating unit include: entering fresh scores, using fresh scores to develop current handicaps (which can be checked), updating record cards, and issuing identification cards.

8 Claims, 4 Drawing Figures

ID CARD READER
ID CARD READER
RE-RECORD UNIT
GATE CIRCUIT
SCORES
SC
HC
NAME
IDN
DATES
DAT
T4
GATE CIRCUIT
RE-RECORD UNIT
READ HANDICAP UNIT
DISPLAY GATING & BUFFER NETWORK
HANDICAP COMPUTER
BUFFER
KEYBOARD AND DATE INPUT UNIT
DISPLAY UNIT
RECORD GATES AND BUFFER
ID GATES AND BUFFER
PRINTER
TIMING SYSTEM
T1
T2
T3
T4
T5

SCORE RECORD PROCESSING SYSTEM

RELATED SUBJECT MATTER

This is a continuation-in-part of Ser. No. 100,572, filed Dec. 5, 1979, and entitled "Score Processing System For Use With ID Cards", now U.S. Pat. No. 4,268,744.

BACKGROUND AND SUMMARY OF THE INVENTION

A number of activities involve maintaining a record of individual scores which are subsequently significant. For example, a group of several recent scores turned in by a golfer are processed to provide his current handicap. In that regard, common practice involves the use of rather elaborate systems for computing and preserving records for individual players at their associated golf clubs. Traditionally, after each round of golf, each player's score is supposed to be accurately recorded. Periodically (usually after some significant delay) a number of such scores are used to compute each player's handicap, which figures are posted.

Pursuing the above example, it is noteworthy that player handicaps are quite significant in golf not only in arranging play but additionally in determining the outcome of such play. In view of the importance of a player's individual handicap, players generally are more comfortable if they have a confirmation of a competitor's handicap. If the competitor is a visiting player, his handicap is likely to be unconfirmed and consequently may be doubted. In view of these considerations, a need exists for an effective and convenient system for providing reliable, fresh score and handicap information, available at a golfer's home club as well as at other courses.

As suggested, situations similar to that described above also exist in other sports, as for example in bowling. The volume and complexity of calculations that are involved in these situations often result in the use of a computing service to develop the desired data. It is to be appreciated that normally, the practice involves some inconvenience, expense, and substantial time delay. As a consequence, a need exists for an expedient and economical system for maintaining player scoring data, as handicaps, that are truly current, readily available, and that can be provided in the form of a personally carried document.

In general, the present invention may be embodied for use with various records, one of which (a reference or record card) bears a recording medium as in the form of a magnetic stripe. The magnetic stripe may be of high energy material with the consequence that the record is durable and reliable. In the use of the system hereof in a golfing application, for example, the magnetic stripe records a player's history, along with the player's handicap which is maintained current in accordance with his games of play. Additionally, the system incorporates printer facilities for providing a visual record on the record card. Furthermore, the system provides an authentic identification (player identification card) for use by a visiting player to authentically indicate his handicap.

Structurally, the system as disclosed herein incorporates apparatus for processing both record cards bearing a recording medium, e.g. a magnetic stripe, and identification cards. Information is sensed from the record card to accommodate a variety of operations. For example, in a golf application, the system may simply manifest the current handicap of a player. The system may receive the score resulting from recent play, then process such score along with data from the card to provide a fresh handicap. The system may also reveal a history of several recent scores. Furthermore, the system can imprint the record card with current score data and can imprint identification cards with current handicap data to provide authentic information in a personally portable form.

BRIEF DESCRIPTION OF THE DRAWINGS

In the drawings, which constitute a part of this specification, an exemplary embodiment demonstrating various objectives and features hereof is set forth as follows.

DESCRIPTION OF ILLUSTRATIVE EMBODIMENT

As indicated above, a detailed illustrative embodiment of the invention is disclosed herein. However, embodiments may be constructed in accordance with various forms, some of which may be rather different from the disclosed illustrative embodiment. Consequently, the specific structural and functional details disclosed herein are merely representative, yet in that regard they are deemed to provide the best embodiment for purposes of disclosure and to provide a basis for the claims herein which define the scope of the present invention.

Figure 1:
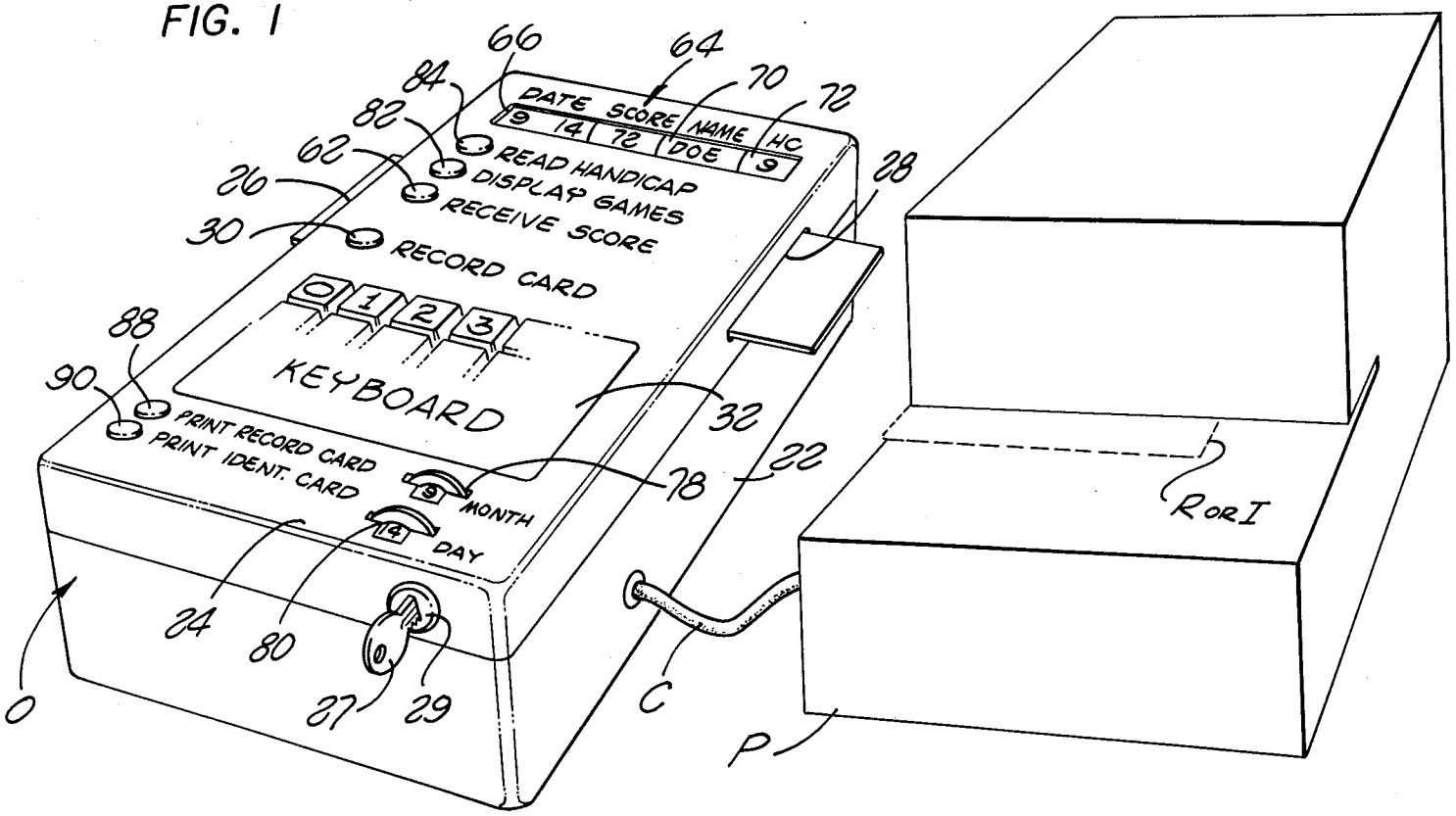
FIG. 1 is a perspective view of a system constructed in accordance with the present invention.

Referring initially to FIG. 1, the system of the present invention is illustrated to be embodied as two distinct, but interconnected structures. Specifically, a processing or operating unit O is connected by a cable C to a printer P. The operating unit O operates with a record card R (FIG. 2) while the printer P functions with both the record card R and an identification card I (FIG. 3). Of course, a variety of different techniques and structures may be employed, utilizing the present invention; and in that regard, it is noteworthy that a single physical unit may be employed or alternatively several separate structures might be used. However, in that regard, the disclosed embodiment is in accord with an actual operating form of the structure.

Pursuing the illustrative example herein, certain operations are performed by the operating unit O while other operations are performed by the printer P. Specifically, the operating unit O displays a player's handicap data, magnetically records a fresh score, magnetically updates the record card R and controls the printer P to imprint cards. The printer P imprints visible data on both the record card R (FIG. 2) and the identification card I (FIG. 3).

Figure 2:
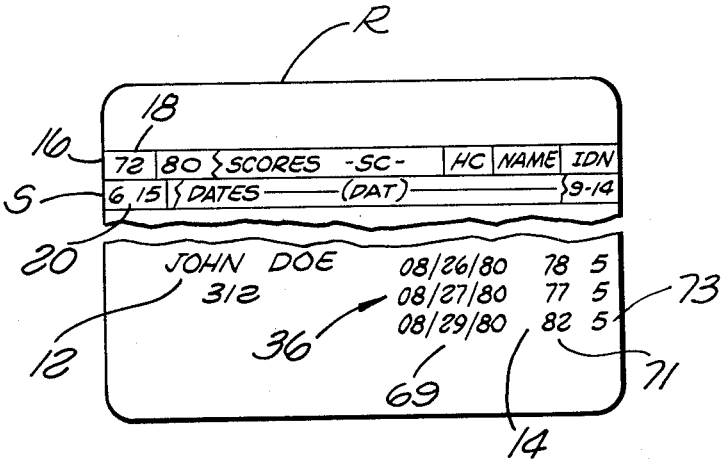
FIG. 2 is a top plan, fragmentary view of a record card for use in association with the system of FIG. 1.
Figure 3:
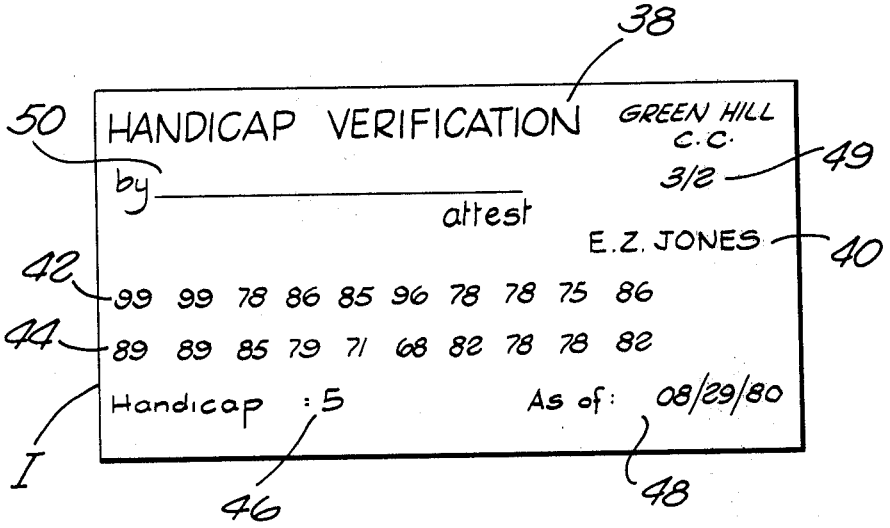
FIG. 3 is a top plan view of an identification card for use in association with the system of FIG. 1.

Prior to considering the structure of FIG. 1 in greater detail, reference will first be made to FIGS. 2 and 3 illustrating exemplary forms of the cards for use with the structure of FIG. 1. The record card R may take various forms, and in one embodiment is a cardboard sheet carrying a magnetic stripe S. The indicia on the record card R is variously printed and may involve the player's identification and other material as described below. Of course, arrangements will vary with specific applications; however, the player's name 12 may be typewritten, while scoring data 14 is recorded by the printer P (FIG. 1). Various club or other data, of course, may also be imprinted as indicia on the card.

As with regard to the structures of the card R, the magnetic stripe S also may vary widely. However, one recording format for the stripe S is indicated in FIG. 2. Assuming the stripe S is magnetic medium, the actual record thereon will be invisible. However, the representative data recorded is illustrated in FIG. 2, in a perceivable form. Specifically, an upper track 16 (left to right) records a series of score data words 18 for the cardholder, each of which are designated by the letters SC and comprise six binary bits. Handicap and identification data follow the score words 18. The second track 20 carries a series of dates, indicated by the letters DAT, which are individually associated to identify each of the scores 16 designated SC. The date words or data DAT each comprise nine binary bits.

Considering the data following the scores in track 16, a data word HC represents the player's current handicap and comprises five bits. Following that data word, a data word NAM reveals the cardholder's identification (e.g. initials or name) and takes the form of a thirty-six bit word. Finally, the data word IDN indicates an assigned identification number for the card holder and is of ten bits in length.

In summary, the magnetic stripe S on the record card R carries the recent scores (SC) of a player, from which his handicap is computed. The handicap (HC) is also recorded along with certain identification data (NAM and IDN). The card also records the dates (DAT) when individual scores were recorded. For convenience, the data is represented by designated signals as indicated above along with other data, as set forth below in chart form.

| SIGNALS OR DATA | | |
|---|---|---|
| Designation | Name | Bits |
| IDN | Identification number | 3 |
| NAM | Name | 36 |
| HC | Handicap | 5 |
| DAT | Date | 9 |
| SC | Scores | 6 |
| RHC | Read handicap (command) | 1 |
| DIS | Display games (command) | 1 |
| RCS | Receive score (command) | 1 |
| RIC | Record identification card (command) | 1 |
| PRC | Record record card (command) | 1 |
| PIC | Print identification card (command) | 1 |

The identification card I (FIG. 3) disclosed in an exemplary form, carries a variety of indicia; however, no magnetic medium. The card serves as an authentication device for a player's handicap. Of course, any of a wide variety of anticounterfeit techniques or devices can be incorporated. Further details of the card I are given below.

Returning now to further consider the system of FIG. 1, the operating unit O comprises a housing 22 containing operating structure and supporting a control panel 24. While other card handling techniques are well known, in the exemplary system, aligned card entry and exit ports are defined for record cards at the sides of the housing 22. Specifically, an entry slot 26 is located at the left side of the housing 22 while an exit slot 28 is located on the opposed right side of the housing 22. An inserted card may be read and recorded in passing through the unit O.

Preliminarily, it may facilitate an understanding of the system to pursue the various functional operations somewhat chronologically in the likely sequence of their occurrence. Therefore, assume initially that a fresh record card R is to be recorded for a new member of a club or other facility. That is, a record card R as illustrated in FIG. 2 has been designated for a subject or member and is now to be recorded. Preliminarily, the member's name 12 and club number may be typed on the card R. Before operating the unit O in a recording mode, a key 27 must be used to actuate a lock 29 for energizing the unit. As individual scores are not available, no scores are recorded. However, on the basis of some authority, the new member is assigned a specific handicap HC. That handicap, along with his name and number is recorded.

The record card R for the subject member is placed in the entry slot 26 (FIG. 1) and a "record card" button 30 is depressed to activate a keyboard 32 which is then used for forming signals representative of the data: HC, NAM, and IDN. In accordace with a standard format, the data signals are formed by the keyboard 32 and magnetically recorded in the locations indicated in the stripe S on the card R (FIG. 2). After the record card R is recorded, it is passed from the housing 22 through the delivery slot 28 (FIG. 1).

After the initial preparation of the record card R, subsequent use accomplishes complete data in the tracks 16 and 20 as will be described in detail below. Also, the printer P is used to print a history 36 of games on the card R (FIG. 2). Thus, a perceivable record provides convenient data and a back up for the magnetic record of the stripe S.

The printer P also serves to print information on the identification card I (FIG. 3) under the control of the operating unit O. Considering the indicia on the card I, bulk printed lettering 38 may designate a card caption and a club or golf course. Other indicia is handwritten or printed (card by card) as by the printer P. Specifically, the player's name 40 is printed along with: two rows 42 and 44 of recent scores, the handicap 46 and the date 48. Finally, a signature 50 authenticates the identification card I.

Resuming the description of functional operations, by the operating unit O, assume now that a subject of a record card R has played a round of golf. The resulting score will be entered by the operator of the unit O. Specifically, with the key 27 in place, the record card for the subject player is drawn from a file and passed through the slot 26, somewhat concurrently depressing a button 62 adjacent the legend "receive score". As a consequence, the keyboard 32 is energized to accept the score which will be keyed into the operating unit O in a pre-established format. The stripe S is recorded with fresh data supplementing the prior record from the stripe. To confirm the input, data is displayed in the window 64. Specifically, a display section 66 shows the date while sections 68, 70, and 72 respectively display the new score, the subject's name, and the handicap. Note that the date signals (DAT) are derived from rotary switches 78 and 80 in the panel 24.

With the fresh data recorded on the stripe S, the record card is next placed in the printer P to receive the entry. The printer P is controlled by the unit O to enter data in each of the columns for dates 69, scores 71, and handicaps 73. This operation is controlled by the command button 88.

Other operations of the unit O include: displaying a record of the games (command button 82), indicating the present magnetically recorded handicap (command button 84), and controlling the printer P to print an identification card I (command button 90).

Figure 4:
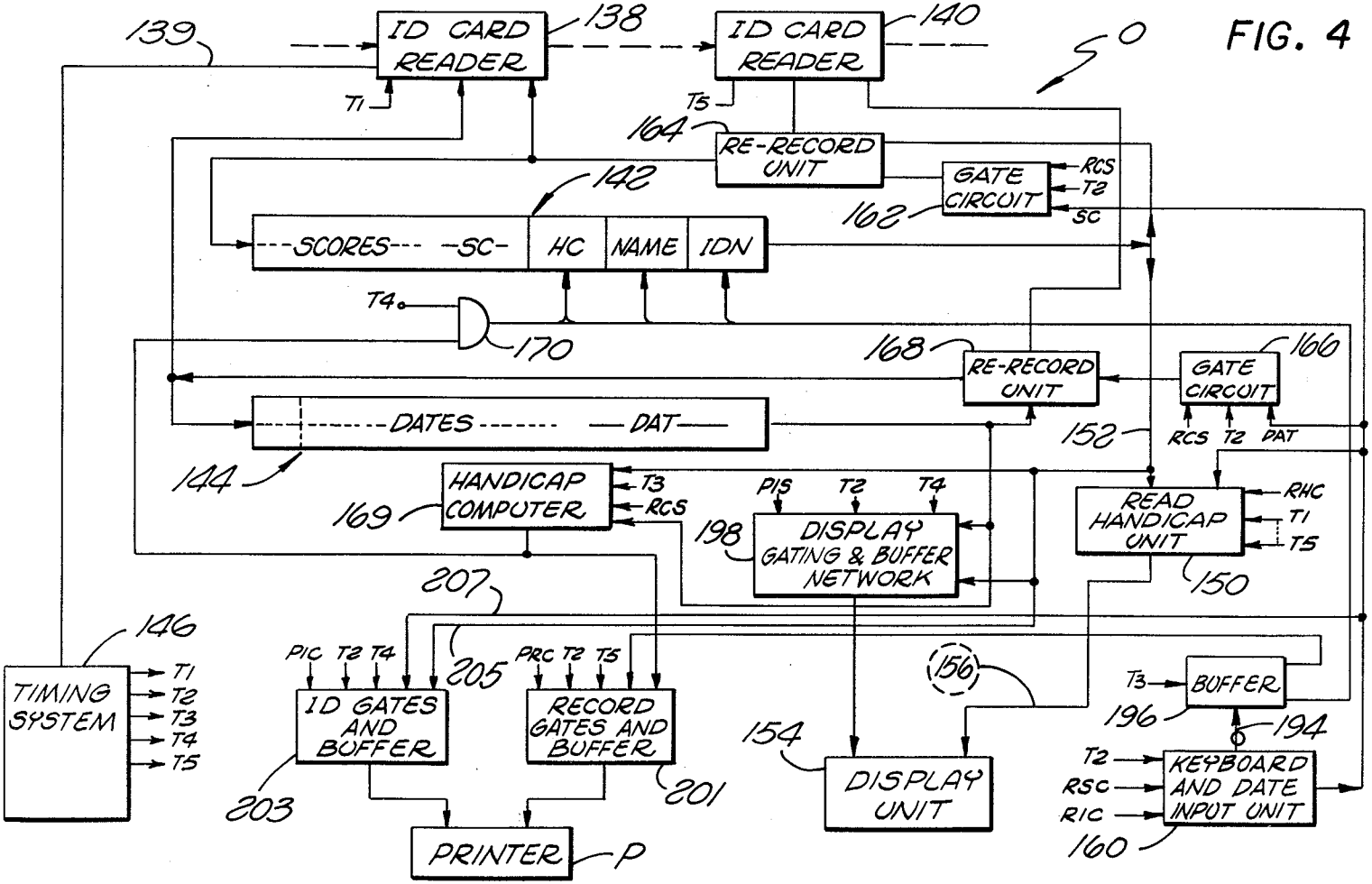
FIG. 4 is a block diagram of the system of FIG. 1.

To perfect a complete understanding of the system, reference will now be made to FIG. 4, illustrating the detailed structure of the apparatus of FIG. 1. The operating unit O incorporates a card reader 138 (FIG. 4) and a card recorder 140. Various forms of such devices are well known and in widespread commercial use. In accordance with somewhat conventional operation, the card reader 138 senses the leading edge of an inserted card R, and is accordingly actuated to move the card while concurrently providing a pulse though a conductor 139 to initiate a cycle of operation by a timing system 146 (FIG. 4, lower left). Essentially, the timing system provides a series of sequencing signals T1, T2, T3, T4, and T5 as well known in the art. These are two-state or binary signals and each commands certain operations during the interval when it is in a high state.

When actuated as indicated above, the reader 138 senses the magnetic tracks 16 and 20 (FIG. 2) to load a pair of registers 142 and 144 that receive the full record from both of the tracks 16 and 20. That is, the register 142 receives the score signals SC along with the data represented by the signals HC, NAM, and IDN from the track 16. Somewhat similarly, the register 144 receives the date signals DAT from the track 20 associated with individual golf scores recorded.

With the data from the card R in the registers 142 and 144, it may be cycled for access and various processing operations. After such processing, the data may be modified and passed from the registers 142 and 144 to freshly record the individual tracks 16 and 20 on the card R by the recorder 140.

As a preliminary operation, consider the manner in which the system reads data and displays it as illustrated in FIG. 1. The involved structure is the read handicap unit 150 (FIG. 4, central right) which is connected to receive selectively the contents of the register 142 through a signal path 152 and provide signals to a display unit 154 (FIG. 4, lower central) through a signal path 156. The unit 150 is connected to receive the command signal RHC (read handicap) along with select timing signals T1–T5. Accordingly, the data from the unit 150 actuates the display unit 154 showing the date (from unit 160), the last score, the player's name (or a part thereof), and the handicap. The display continues until the timing signals terminate (either automatically or by external control).

The operation of the unit O to receive a fresh score and update the handicap data word HC will now be considered. In general, the operation involves again sensing the tracks 16 and 20, then forming the command signal RCS high and actuating the keyboard 32 (FIG. 1) to provide input signals (fresh score) from the input unit 160 (FIG. 4, lower right). Of course, a wide variety of structures are well known and widely used for providing representative digital-signal data in response to depression of individual data keys.

Pursuing the operation of entering a fresh score in somewhat greater detail, the operator depresses a button 62 (FIG. 1) designated "receive score" which provides a high form of the command signal RCS for a predetermined duration. Note that the unit O requires the insertion of the key 27 to enable the imput operation.

During the first phase of operation (period of the timing signal T1 being high) the data from the tracks 16 and 20 again is sensed from the card R and placed in the registers 142 and 144 just as described above. Next, with the record signal RCS in a high state, the scores of prior games (represented by the signals SC) are shifted one location in the register 142 with the result that the oldest score is lost and a space becomes available for the fresh score. Such shifting operations in registers are well known and a variety of accommodating structures are in widespread use to accomplish such a displacement along with the insertion of fresh data. Specifically, in the system of FIG. 4, the operation is performed by moving the contents of the register 142 through a re-record unit 164 along with signals from a gate circuit 162 (upper right) during the interval of T2. It is to be noted that the gate circuit 162 and the display unit 154 receive the fresh score signal SC (current score) from the keyboard and date input unit 160.

A similar shifting and entering operation is performed on the data contained by the register 144 (center), i.e. the dates of the record scores. Specifically, the current date is represented by signals DAT applied to a gate circuit 166 (central right) along with the signal RCS and the timing signal T2. Consequently, the shifting and insertion operation is performed by a re-record unit 168, cycling the contents of the register 144. At the conclusion of these operations, the registers 142 and 144 contain current information on scores and dates including the latest score and date.

The next operation in the sequence involves the calculation of the fresh handicap during the interval of T3. Specifically, during the interval of T3, the contents of the register 142 is supplied through the data path 152 to a handicap computer 169 for processing. Such a transfer is commanded by the signal RCS being in a high state. The handicap computer may take a variety of forms, for example, a golf computer is disclosed in U.S. Pat. No. 3,665,494 issued May 23, 1972. In an alternative embodiment, the computer may take other forms as, for example, a bowling score computer, a form of which is disclosed in U.S. Pat. No. 3,974,483 issued Aug. 10, 1976.

Operationally, the handicap computer 169 provides signals representative of the newly computed handicap, i.e. signals HC. During the interval of the timing signal T4, such signals HC are supplied from the handicap computer 169 through an "and" gate 170 to register the fresh handicap HC in the register 142. Accordingly, the registers 142 and 144 contain current information reflecting the fact that a score has been received and concurrently the handicap data word HC adjusted if appropriate.

During the next time interval (indicated by the signal T5 being in a high state), the contents of the registers 142 and 144 are cycled and provided through the units 164 and 168, respectively, to the recorder 140 for freshly recording the tracks 16 and 20 on the identification card C. The card C is then ejected. At this point it is perhaps noteworthy to observe that almost no delay exists between the time when a fresh game of golf is completed and the score of that game is reflected in the player's handicap. Therein lies a major and distinct advantage of the present system.

At this stage of operations, the printer P will usually be actuated to print the recent data on the card R using the printer P (FIGS. 1 and 4). Note that a variety of printers can be used; and in the illustrative embodiment, a slip printer is employed as can be obtained from either Interface Electronics of Allston, Massachusetts (Model No. 400M) or NCR Corporation (Model No. 2193).

Recapitulating, the card has been ejected from the unit O; however, during the interval of timing signal T3, the recent score (SC) and the date (DAT) were passed from the buffer 196 to gates and buffer 201. During the same time (T3), the fresh handicap (HC) was supplied in signal form from the computer 169 for registration in the buffer 201. Consequently, when the card R is ejected from the unit O, after a fresh score is entered, the fresh score data, date, and new handicap is in the buffer 201.

The operation now simply involves placing the card R in the printer P and depressing the button 88 (FIG. 1) to form the signal PRC in a high state. That signal initiates another timing cycle and actuates the buffer 201 to control the printer in accordance with the data in the buffer 201. Specifically, the signals DAT, SC, and HC drive the printer P to record data in the columns 60, 71 and 73 (FIG. 2) representative of the current date, score, and handicap, respectively. Again, the timing signals sequence the operation to termination as well known in the digital arts. Thus, the record card R (FIG. 2) is brought current both with respect to the printed record and the magnetic record.

As indicated above, not infrequently the need arises for a handicap verification document. Specifically, the identification card I (FIG. 3) is illustrative and in a form that can be conveniently carried by a player to golf courses away from his home course, for identification and handicap authentication. The operation of the system to accomplish the card I will now be considered in detail.

A blank form of the card I is placed in the printer P as indicated in FIG. 1. The button 90 (print identification card) is then depressed to command the printing operation and form the signal PIC in a high state. The result is an initial sequence of operations that is similar to an operation explained below with regard to displaying games and is commanded by the signal DIS. Specifically, the score data SC, along with the handicap signal HC, the name signal NAM, and the identification signal IDN, are registered in a buffer 203 bearing the designation, identification gates, and buffer (FIG. 4, lower left). As described above, the operation is performed as data is cycled in the registers 142 and 144. The buffer 203 is actuated by the command signal PIC, receiving the indicated data signals through data paths 205 and 152. Similarly, the current date signals DAT are received from the unit 160 through a signal path 207.

Next, a timing sequence is initiated so that the buffer 203 sequentially supplies data signals (SC, HC, NAM, and IDN) to the printer P to imprint the card I (FIG. 3) with the subject's name 40 (NAM), rows 42 and 44 of game scores (SC), the handicap 46 (HC), the date 48 (DAT), and the subject's identification 49 (IDN). The card, so printed, may be checked by the operator and then executed with the signature 50 to complete the document. Accordingly, the identification card is complete and ready for use.

As discussed above with respect to the unit O of FIG. 1, the system may be employed to record the handicap, name, and the identification on a fresh card. That operation is performed by inserting a fresh card in the unit O. Normally, the tracks 16 and 20 of the card will bear no previous recording with the consequence that the registers 42 and 144 remain clear after the card has been read. With the application of the signal RIC (record card) in a high state at the input unit 160 (FIG. 4, lower right), the keyboard is enabled to provide digital signals indicative of the handicap, the holder's name, and his identification number. Specifically, data is encoded as the representative signals HC, NAM, and IDN. Such signals then are supplied from the unit 160 through a cable 194 to a buffer 196. Subsequently, during the interval of the timing signal T3, the signals HC, NAM, and IDN are entered in the register 142 in a parallel fashion. Accordingly, the initial record is produced which is subsequently recorded upon the card when the contents of the register 142 is transferred through the re-record unit 164 to the recorder 140. The card C then will be continued in its use until such time as a sufficient number of scores have been recorded to formulate a basis for computation of a handicap as required by the computer 168.

Still another alternative operation of the operating unit O involves sequentially reading each of the dated scores from the tracks 16 for display in the window 64 (FIG. 1). In such operation, the contents of the registers 142 and 144 are transferred to a gating and buffer network 198 (FIG. 4, central) during the occurrence of a command signal DIS (display games). From the network 198, each game and date is sequentially supplied to the display unit 154 for a metered time interval whereby the intervals of timing signals T2 through T4 are expanded. Of course, a variety of techniques may be employed; however, some seven seconds for each display has been determined in one instance to be satisfactory. As a consequence, the operator of the office unit O as well as the player cardholder may monitor the content of the card to determine and assure that the games as recorded coincide with present recollection. Of course, if a challenge is made, internal policies will come into play. In any event, the system has the operating capability to reveal the full registered content of the tracks 16 and 20.

In view of the above description, it will now be apparent that the system of the present invention may be effectively employed to facilitate and control the use of record cards and identification cards in maintaining and indicating player handicap data. The system functions to provide current handicap or scoring information for players which is readily available and facilitates records. Of course, the system can be implemented using a wide variety of different techniques and structures; and in that regard it is to be appreciated that the system as presented herein is merely an illustrative embodiment deemed best for present purposes; however, recognizing that the scope hereof shall be in accordance with the claims as set forth below.

What is claimed is:

1. A record system for scoring, as in golf, for operation with record cards or the like, bearing a record medium comprising:

means for sensing said record medium to provide signals from a specific card identified with a specific person and representative of a scoring composite for that person;

a controlled access input panel for forming signals representative of a current score by said specific person;

computer means for receiving said signals representative of a current score and said signals representative of said scoring composite to compute a fresh scoring composite;

recording means for recording said signals on said cards, updated to include said current score; and printing means for printing representations of said fresh scoring composite on said record cards.

2. A record system in accordance with claim 1 for use with identification cards, wherein said input panel further includes means for commanding an alternative printing operation and said system further includes alternative printing operation means for printing said scoring composite in a format for one of said identification cards.

3. A record system according to claim 2 wherein said means for sensing includes means for sensing signals to identify said specific person and furthermore wherein said alternative printing operation means includes means for printing indicia to identify said specific person on said identification card.

4. A record system according to claim 2 wherein said means for sensing includes means for sensing a plurality of individual scores in addition to said scoring composite and furthermore, wherein said alternative printing operation means includes means for printing indicia to indicate said plurality of individual scores.

5. A record system according to claim 1 wherein said input panel further includes means for forming signals representative of dates identified with said current scores; and wherein said printing means further includes means for printing indicia manifesting said dates.

6. A record system according to claim 5 wherein said means for sensing further includes means for sensing said record medium to provide a plurality of individual scores and a plurality of dates identified with said individual scores.

7. A record system according to claim 1 wherein said printing means comprises a slip printer.

8. A system according to claim 1 further including a display means for receiving signals to display said current score.

* * * * *